United States Patent [19]

Rosenthal et al.

[11] 4,255,248

[45] Mar. 10, 1981

[54] TWO-STAGE COAL LIQUEFACTION PROCESS WITH PROCESS-DERIVED SOLVENT HAVING A LOW HEPTANE-INSOLUBILES CONTENT

[75] Inventors: Joel W. Rosenthal, El Cerrito; Arthur J. Dahlberg, Pinole; Christopher W. Kuehler, Larkspur, all of Calif.

[73] Assignee: Chevron Research Company, San Francisco, Calif.

[21] Appl. No.: 73,156

[22] Filed: Sep. 7, 1979

[51] Int. Cl.[3] ..... C10G 1/00

[52] U.S. Cl. ..... 208/8 LE; 208/10

[58] Field of Search ..... 208/8 R, 8 LE, 10

[56] References Cited

U.S. PATENT DOCUMENTS

| | | | |
|---|---|---|---|
| 3,707,461 | 12/1972 | Gatsis | 208/8 LE |
| 3,852,182 | 12/1974 | Sze | 208/8 LE |
| 3,997,425 | 12/1976 | Gatsis et al. | 208/8 LE |
| 4,018,663 | 4/1977 | Karr | 208/10 |
| 4,081,358 | 3/1978 | Tan et al. | 208/8 LE |
| 4,081,359 | 3/1978 | Gatsis et al. | 208/8 LE |
| 4,081,360 | 3/1978 | Tan et al. | 208/8 LE |
| 4,082,643 | 4/1978 | Gatsis et al. | 208/8 LE |
| 4,082,644 | 4/1978 | Gatsis et al. | 208/8 LE |
| 4,083,769 | 4/1978 | Hildebrand et al. | 208/10 |
| 4,111,788 | 5/1978 | Chervenak et al. | 208/10 |

*Primary Examiner*—Veronica O'Keefe

*Attorney, Agent, or Firm*—D. A. Newell; W. H. Hooper; A. H. Uzzell

[57] ABSTRACT

Disclosed is a two-stage process for the production of clean liquid hydrocarbons from coal. In the process subdivided coal is dissolved in a process derived solvent at a temperature in the range 425° C.-480° C. The dissolver effluent is passed through a catalytic reactor operating under hydrocracking conditions, including a temperature in the range 340° C.-400° C. to produce normally liquid products and recycle solvent. The solvent is further cooled to precipitate unconverted heptane insolubles prior to recycle to the dissolution stage.

8 Claims, 1 Drawing Figure

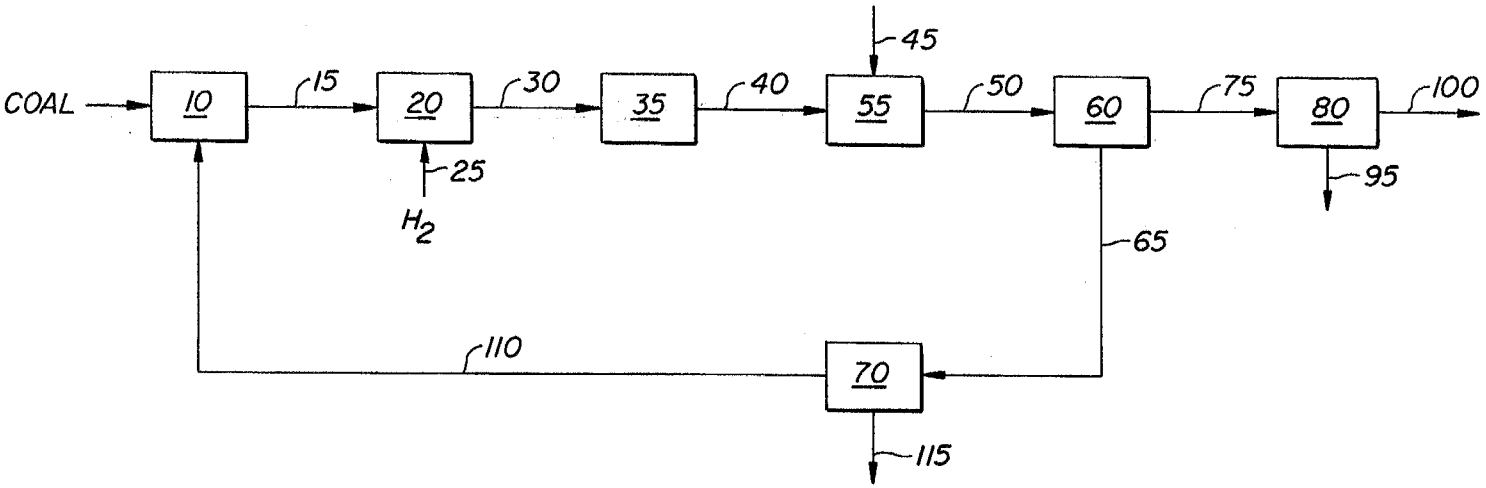
COAL
10
15
20
25
$H_2$
30
35
40
55
45
50
60
65
70
110
115
75
80
95
100

TWO-STAGE COAL LIQUEFACTION PROCESS WITH PROCESS-DERIVED SOLVENT HAVING A LOW HEPTANE-INSOLUBILES CONTENT

BACKGROUND OF THE INVENTION

1. Field of the Invention

The present invention relates to an improved process for the liquefaction of raw coal. More particularly, the invention relates to a process wherein subdivided coal is dissolved in a process derived solvent having a low heptane insolubles content and is subsequently hydrocracked under specified process conditions.

2. Prior Art

Coal is our most abundant indigenous fossil fuel resource, and as a result of dwindling petroleum reserves, concerted research efforts are being directed toward recovery of liquid hydrocarbons from coal on a commercial scale. A promising approach in this field is the direct liquefaction of coal accompanied with minimum gas production.

This approach has principally evolved from the early work of F. Bergius, who discovered that transportation fuels could be produced by the high pressure hydrogenation of a paste of coal, solvent and catalyst.

Later discoveries revealed the advantage of using specific hydrogenation solvents at lower temperatures and pressures. With these solvents, such as partially saturated polycyclic aromatics, hydrogen transfer to the coal is facilitated and dissolution enhanced. However, the products from single-stage dissolvers are typically high in asphaltenes, have high average molecular weights and high viscosities. These qualities present considerable obstacles in removing the fine coal residue particles suspended in the product which usually range from 1 to 25 microns in diameter.

The complete nature of the coal residue or undissolved solids is not wholly understood, but the residue appears to be a composite of organic and inorganic species. The residue organic matter is similar to coke and the inorganic matter is similar to the well known coal-ash constituents. The removal of these particles is of course necessary to produce a clean-burning, low-ash fuel.

As a result, numerous researchers have focused their efforts upon devising methods to facilitate residue removal by nonconventional techniques. One of the approaches advocated is the addition of a precipitant or anti-solvent to the residue laden product. Suitable precipitating agents include aliphatic or naphthenic hydrocarbons. These agents are miscible with the liquefaction solvent but do not dissolve the coal residue which is thereby precipitated. U.S. Pat. Nos. 3,852,182 and 4,075,080, incorporated herein by reference, are representative examples of the prior art teachings in this area.

The use of such anti-solvents or precipitating agents is expensive from both capitol and operating standpoints, however, and the procedure still suffers from an additional disadvantage. The product liquids from single stage dissolvers are usually high in asphaltenes. Traditionally asphaltenes have been defined as hydrogen-deficient high molecular weight hydrocarbonaceous materials which are insoluble in straight-chain aliphatic hydrocarbons such as n-heptane. It is now recognized that the broader definitions of asphaltenes relate to a wide spectrum of hydrocarbonaceous material which may be further characterized. A heptane insoluble asphaltene may be further extracted by using benzene, chloroform and dimethyl formamide solvents in that order. The benzene soluble asphaltenes are characterized with a high proportion of molecules having a molecular weight in the range of from about 450 to about 650 and only mildly hydrogen-deficient. The chloroform soluble asphaltenes are characterized with a high proportion of molecules having a molecular weight in the range of from about 1000 to about 1200. The DMF soluble asphaltenes are characterized with a high proportion of molecules having a molecular weight in the range from about 1800 to about 2000 and are severely hydrogen deficient. In a typical coal liquefaction extract the benzene, chloroform and DMF soluble asphaltene fractions would be expected to be about 50, 35 and 15 volume percent, respectively, of the heptane insoluble asphaltene fraction.

As used in the specification and claims herein this spectrum of high molecular weight hydrocarbonaceous compounds will be generically referred to as heptane insolubles to avoid confusion with the traditional definition of asphaltenes, which would exclude the benzene insoluble materials.

Although asphaltenes are soluble in the coal solvents employed, they tend to precipitate from solution upon the addition of short-chain anti-solvents. Their precipitation aids in the agglomeration of the insoluble ash but results in substantial product loss from the high-boiling fractions of the dissolved coal. A recognition of this problem and an attempt to solve it is aptly illustrated in U.S. Pat. No. 4,029,567, also incorporated herein by reference.

J. Gatsis and G. Tan, apparently recognizing the above problem, proceeded to attack it from a different angle in U.S. Pat. No. 4,081,360, incorporated herein by reference, by suppressing asphaltene formation during the coal liquefaction step. The patent teaches liquefying coal with a low asphaltene hydrogenated coal solvent and then adding a light aromatic solvent to aid in ash separation. Other teachings to the same effect, include U.S. Pat. Nos. 3,997,425, 4,081,358, 4,081,359, 4,082,643 and 4,082,644.

Direct two-stage coal liquefaction processing evolved by the addition of a catalytic stage to further hydrogenate and break down the higher molecular weight products produced in the dissolver. In retrospect, and with the clarity hindsight often provides, such a step does not seem unprecedented. However, the direct passage of a solids-laden stream through a catalytic reactor was therefor considered impractical at best. The two-stage units solved most of the coal residue removal problems since the hydrocracked product was relatively light and of relatively low viscosity, thereby permitting the use of conventional solids removal techniques. The asphaltene content of the product effluent from the catalytic reactor was drastically reduced by the catalytically induced hydrogenation. Representative patents covering two stage liquefaction processes include U.S. Pat. No. 4,018,663 issued to C. Karr, Jr. et al, U.S. Pat. No. 4,083,769 issued to R. Hildebrand et al and U.S. Pat. No. 4,111,788 issued to M. Chervenak et al.

U.S. Pat. No. 4,018,663 discloses a two-stage process in which a coal-oil slurry is passed through a first reactor containing a charge of porous, non-catalytic contact material in the presence of hydrogen at a pressure of 1,000 to 2,000 psig and a temperature of 400° to 450° C. The effluent from this reactor is then preferably filtered to remove the coal residue and passed to a catalytic reactor for desulfurization, denitrification and hydrogenation of the dissolved coal.

U.S. Pat. No. 4,083,769 discloses a process wherein a preheated coal-solvent slurry is passed with hydrogen through a first dissolver zone operated at a pressure in excess of 3,100 pounds per square inch and at a higher temperature than the preheater. The dissolver effluent is then hydrogenated in a catalytic zone also maintained at a pressure in excess of 3,100 pounds per square inch and at a temperature in the range of 700° to 825° F. to produce liquid hydrocarbons and a recycle solvent.

U.S. Pat. No. 4,111,788 discloses a process wherein a coal-oil slurry is passed through a dissolver containing no catalyst and the effluent therefrom is subsequently treated in a catalytic ebullated bed at a temperature at least 25° lower than the temperature of the dissolver. A portion of the product liquid is preferably recycled for use as solvent.

SUMMARY OF THE INVENTION

The present invention provides a process for liquefying coal to produce normally liquid clean hydrocarbons, accompanied by a minimum gas production with high operating stability. In the process a coal-solvent slurry is prepared by mixing subdivided coal with a solvent and passed with added hydrogen through a first dissolving zone which is free of externally supplied catalyst or contact materials. The dissolver is operated at a temperature in the range of 800° to 900° F. to substantially dissolve said coal. The effluent from the dissolver is then contacted in a catalytic reaction zone under hydrocracking conditions including a temperature in the range of 650° to 750° F. and a pressure in the range of 1000 to 3000 psig to produce a second effluent having a normally liquid portion which contains a minor portion of heptane insoluble materials, normally in the range of 2 to 5 weight percent of the normally liquid portion. At least a portion of the normally liquid effluent from the catalytic reaction zone is cooled, preferably to below 200° F., to precipitate substantially all of the remaining heptane insolubles. The cooled effluent from which the heptane insolubles have been precipitated, is recycled as solvent for the coal.

Preferably the effluent which is recycled for use as slurry solvent is a 200° C. plus boiling fraction. The hydrocracking catalyst employed in the reaction zone is preferably maintained in a fixed bed, although an ebullated or moving bed may be used. Preferred hydrocracking catalysts include hydrogenation components such as nickel-molybdenum, cobalt-molybdenum or nickel-tungsten on a weakly acidic cracking base such as alumina.

The material passing through the dissolving zone preferably has a residence time of 0.25 to 1 hour. The dissolving zone is free of any external catalyst or other contact particles or materials, but may be baffled to provide plug-like flow conditions. A slurry hourly space velocity is maintained in the catalytic reaction zone in the range of 0.1 to 2 and preferably 0.2 to 0.5.

BRIEF DESCRIPTION OF THE DRAWING

The drawing illustrates suitable flow paths in block form for practicing one embodiment of the present invention.

Coal and a solvent having a low heptane insolubles content are slurried in mixing zone 10 and passed through line 15 to dissolving zone 20. Hydrogen is added to dissolver 20 and the effluent therefrom passes via line 30 to catalytic reaction zone 35. The products from zone 35 are passed to separation zone 55 for the removal of light gases, and the liquids-solids stream from zone 55 pass to a first solid separation zone 60. From zone 60 the solids-lean stream 65 passes to precipitation zone 70 to produce recycle solvent 110. The solids-rich stream from zone 60 passes to a second solid separation zone 80.

DESCRIPTION OF PREFERRED EMBODIMENT

Referring to the drawing in detail, subdivided coal is mixed with a hydrogen-donor solvent in mixing zone 10. The basic feedstock of the present invention is a solid subdivided coal such as anthracite, bituminous coal, sub-bituminous coal, lignite, or mixtures thereof. The bituminous and sub-bituminous coals are particularly preferred, and it is also preferred said coals be comminuted or ground to a particle size smaller than 100 mesh, Tyler standard sieve size, although larger coal sizes may be processed.

The solvent is comprised of partially hydrogenated polycyclic aromatic hydrocarbons, generally having one or more rings at least partially saturated. It is derived from the process as hereinafter described and is preferably a 200° C. or higher boiling fraction, essentially free of heptane insolubles and insoluble solids. While lower boiling fractions may be used, such fractions would tend to unnecessarily lower the hydrogen partial pressure of the unit and thus be of questionable value. Furthermore, the lower boiling fractions do not exhibit the higher viscosities needed for good coal transport properties in slurry form.

The subdivided coal is mixed with the solvent in a solvent to coal weight ratio from about 0.5:1 to 5:1, and preferably from about 1:1 to 2:1. From mixing zone 10, the slurry is pressure-fed or pumped through line 15 to dissolving zone 20. The dissolver is operated at a temperature in the range of 425° C. to 480° C., preferably 425° C. to 455° C. and more preferably from 440° C. to 450° C. for a length of time sufficient to substantially dissolve the coal. At least 70 weight percent, and preferably greater than 90 weight percent, of the coal, on a moisture and ash-free basis, is dissolved in zone 20, thereby forming a mixture of solvent, dissolved coal and insoluble solids, or coal residue. Coal slurry temperatures are maintained below 480° C. in the dissolver to prevent excessive thermal cracking, which substantially reduces the overall yield of normally liquid products.

Hydrogen is also introduced into the dissolving zone through line 25 and normally comprises fresh hydrogen and recycle gas. Other reaction conditions in the dissolving zone include a residence time of 0.1 to 2 hours, preferably 0.25 to 1 hour; a pressure in the range 35 to 680 atmospheres, preferably 100 to 340 atmospheres, and more preferably 100 to 170 atmospheres; and a hydrogen gas rate of 355 to 3550 liters per liter of slurry, and preferably 380 to 1780 liters per liter of slurry. The physical structuring of the dissolver per se is preferably designed so that the slurry may flow upwardly or downwardly therethrough. Preferably the zone is baffled or sufficiently elongated to attain plug flow conditions, which permit the process of the present invention to be practiced on a continuous basis. The dissolver contains no catalyst or contact particles from any external source, although the mineral matter contained in the coal may have some catalytic effect.

The mixture of dissolved coal, solvent and insoluble solids from dissolver 20 is fed through line 30 to a reaction zone 35 containing hydrocracking catalyst. In the hydrocracking zone, hydrogenation and cracking occur simultaneously, and the higher molecular weight compounds are further hydrogenated and converted to lower molecular weight compounds, the sulfur is removed and converted to hydrogen sulfide, the nitrogen is removed and converted to ammonia, and the oxygen is removed and converted to water. Preferably, the catalytic reaction zone is a fixed bed type, although an ebullating or moving bed may be used. The mixture of gases, liquids and insoluble solids preferably passes upwardly through the catalytic reactor but may also pass downwardly.

The catalysts used in the hydrocracking zone may be any of the well-known and commercially available hydrocracking catalysts. A suitable catalyst for use in the hydrocracking zone comprises a hydrogenation component and a mild cracking component. Preferably the hydrogenation component is supported on a refractory, weakly acidic, cracking base. Suitable bases include, for example, silica, alumina, or composites of two or more refractory oxides such as silica-alumina, silica-magnesia, silica-zirconia, alumina-boria, silica-titania, silica-zirconia-titania, acid-treated clays and the like. Acidic metal phosphates such as alumina phosphate may also be used. Preferred cracking bases comprise alumina and composites of silica and alumina. Suitable hydrogenation components are selected from Group VIb metals, Group VIII metals, and their oxides, sulfides or mixtures thereof. Particularly preferred are cobalt-molybdenum, nickel-molybdenum or nickel-tungsten on alumina supports.

The temperature in the hydrocracking zone should be maintained below 410° C. and more preferably in the range of 340° C. to 400° C. to prevent fouling. The temperature in the hydrocracking zone should thus be maintained below the temperature in the dissolving zone by 55° C. to 85° C. and may be accomplished by cooling the dissolver effluent with conventional methods such as indirect heat exchange with other process streams or by quenching with hydrogen. Other hydrocracking conditions include a pressure 35 atmospheres to 680 atmospheres, preferably 70 atmospheres to 205 atmospheres and more preferably 100 to 170 atmospheres; a hydrogen rate of 355 to 3550 liters per liter of slurry, preferably 380 to 1780 liters of hydrogen per liter of slurry; and a slurry hourly space velocity in the range 0.1 to 2, preferably 0.2 to 0.5.

Preferably the pressure in the noncatalytic dissolving stage and the catalytic hydrocracking stage are substantially the same to eliminate interstage pumping.

Preferably the entire effluent from the dissolving zone is passed to the hydrocracking zone. However, since small quantities of water and light gases ($C_1$–$C_4$) are produced in the first stage by hydrogenation of the coal liquids, the catalyst in the second stage is subjected to a lower hydrogen partial pressure than if these materials were absent. Since higher hydrogen partial pressures tend to increase catalyst life, it may be preferable in a commercial operation to remove a portion of the water and light gases before the stream enters the hydrocracking stage. Furthermore, interstage removal of the carbon monoxide and other oxygen-containing gases may reduce hydrogen consumption in the hydrocracking stage due to reduction of the carbon oxides. The product effluent 40 from reaction zone 35 is preferably separated into a gaseous fraction 45 and a solids-lean fraction 50 in zone 55. The gaseous fraction comprises light oils boiling below about 200° C. and normally gaseous components such as $H_2$, CO, $CO_2$, $H_2O$ and the $C_1$–$C_4$ hydrocarbons. Preferably the $H_2$ is separated from the other gaseous components and recycled to the hydrocracking or dissolving stages. The liquid-solids fraction 50 is fed to separation zone 60 wherein the stream is separated into a solids-lean stream 65 and solids rich stream 75. Insoluble solids are separated in zone 60 by conventional methods, for example, hydrocloning, filtering, centrifuging and gravity settling or any combination of said methods. Preferably, the insoluble solids are separated by gravity settling, which is a particularly added advantage of the present invention, since the effluent from the hydrocracking reaction zone has a low viscosity and a relatively low specific gravity of less than one. The low specific gravity of the effluent allows rapid separation of the solids by gravity settling such that generally 90 weight percent of the solids can be rapidly separated. Actual testing indicates that solid contents as low as 0.1 weight percent may be achieved by gravity settlers. Preferably the insoluble solids are removed by gravity settling at an elevated temperature in the range 150° C. to 205° C. and at a pressure in the range 1 atmosphere to 340 atmospheres, preferably 1 atomsphere to 70 atmospheres. Separation of the solids at an elevated temperature and pressure is particularly desirable to minimize liquid viscosity and density and to prevent bubbling. The solids-lean product stream is removed via line 65 and passed to precipitation zone 70, and the solids-rich stream is passed to secondary solids separation zone 80 via line 75. Zone 80 may include distilling, fluid coking, delayed coking, centrifuging, hydrocloning, filtering, settling or any combination of the above methods. The separator solids are removed from zone 80 via line 95 for disposal and the product liquid is removed via line 100. The liquid product is essentially solids-free and contains less than one weight percent solids.

The solids-lean stream, passed via line 65 to zone 70, contains approximately 2 to 5 weight percent heptane insolubles, and approximately 0.1 to 0.5 weight percent coal residue. While the heptane insolubles level is low, and, in fact, lower than advocated by the prior art, it has been discovered that such a level will gradually foul the hydrocracking catalyst in zone 35. This gradual fouling would be insignificant for catalyst operating at higher temperatures; but, for the catalysts operating at the temperatures of this invention the fouling rate will adversely decrease the run life.

In precipitation zone 70 the solids-lean stream is further cooled to a temperature in the range of 16° to 95° C. to precipitate substantially all the remaining asphaltenes, or at least to produce a heptane insolubles level of less than 0.5–1.0 weight percent. The solidified heptane insolubles may then be removed by conventional means such as filtration or centrifugation. After separation, the liquid stream is passed via line 110 to the mixing zone for use as a solvent and the precipitated insolubles pass from the system via line 115.

It is thus observed that in the present invention the costly use of anti-solvents for heptane insolubles removal is eliminated in the production of a superior recycle solvent.

It should be recognized that while it is preferred to separate the solids prior to the heptane insolubles removal step and to subject only a fraction of the effluent and particularly a 200° C.+ fraction to the precipitation step for the removal of the heptane insolubles, it is within the spirit and scope of this invention to cool the entire stream from the reaction zone to precipitate the heptane insolubles with the solids to produce the recycle solvent.

The process of the present invention produces extremely clean, normally liquid products. The normally liquid products, that is, all of the product fractions boiling above $C_4$, have an unusually low specific gravity; a low sulfur content of less than 0.1 weight percent, generally less than 0.02 weight percent and a low nitrogen content of less than 0.5 weight percent, generally less than 0.2 weight percent.

As is readily apparent from the foregoing, the process of the present invention is simple and produces clean, normally liquid products from coal which are useful for many purposes. The broad range product is particularly useful as a turbine fuel, while particular fractions are useful for gasoline, jet and other fuels.

What is claimed is:

1. A process for liquefying coal which comprises:

forming a coal-solvent slurry by mixing subdivided coal with a solvent;

passing said slurry with added hydrogen through a dissolving zone free of externally supplied catalyst and contact particles at a temperature in the range 425°–480° C. to substantially dissolve said coal to produce a first effluent;

contacting at least a portion of said first effluent from said dissolving zone in a reaction zone containing hydrocracking catalyst under hydrocracking conditions, including a temperature in the range of 340°–400° C. and a pressure in the range of 70–205 atmospheres to produce a second effluent, having a normally liquid portion containing heptane-insolubles;

cooling at least a portion of said normally liquid portion of said second effluent to precipitate substantially all of said heptane-insolubles; and recycling at least a portion of the cooled, substantially heptane-insoluble-free, liquid portion for use as coal solvent.

2. A process as recited in claim 1, wherein said portion of said normally liquid portion of said second effluent is cooled to a temperature in the range 16° C.–95° C.

3. A process as recited in claim 1, wherein said portion of said normally liquid portion is a 200° C.+ boiling fraction.

4. A process as recited in claim 1, wherein the normally liquid portion containing heptane insolubles has a heptane insolubles content in the range of 2 to 5 weight percent.

5. A process for liquefying coal which comprises:

forming a coal-solvent slurry by mixing subdivided coal with a solvent;

passing said slurry with added hydrogen through a dissolving zone free of externally supplied catalyst and contact particles at a temperature in the range 425° C.–480° C. to substantially dissolve said coal to produce a first effluent;

contacting at least a portion of said first effluent from said dissolving zone in a reaction zone containing hydrocracking catalyst under hydrocracking conditions, including a temperature in the range of 340° C.–400° C. and a pressure in the range 70–205 atmospheres to produce a second effluent having a normally liquid portion which contains heptane-insolubles and coal residue;

separating a substantial portion of the coal residue from at least a portion of said normally liquid portion of said second effluent to produce a solids-lean liquid;

cooling at least a portion of said solids-lean liquid to precipitate substantially all of said heptane-insolubles; and recycling at least a portion of the cooled, substantially heptane-insoluble-free liquid for use as coal solvent.

6. A process as recited in claim 5, wherein said portion of said solids-lean liquid is cooled to a temperature in the range 16° C.–95° C.

7. A process as recited in claim 6, wherein said portion of the normally liquid portion of said second effluent is a 200° C.+ boiling fraction.

8. A process as recited in claim 6, wherein said normally liquid portion of said second effluent has a heptane-insolubles content in the range of 2 to 5 weight percent.

* * * * *

UNITED STATES PATENT AND TRADEMARK OFFICE

CERTIFICATE OF CORRECTION

PATENT NO. : USP 4,255,248
DATED : March 10, 1981
INVENTOR(S) : Joel W. Rosenthal et al It is certified that error appears in the above-identified patent and that said Letters Patent are hereby corrected as shown below:

Title Page and Col. 1, line 3, "HEPTANE-INSOLUBILES CONTENT" should read --HEPTANE-INSOLUBLES CONTENT--.

Col. 2, line 58, "two stage liquefaction" should read --two-stage coal liquefaction--.

Claim 3, Col. 8, line 5, "portion is" should read --portion of said second effluent is--.

Claim 4, Col. 8, line 8, "portion containing" should read --portion of said second effluent containing--.

Signed and Sealed this

*Twenty-first* Day of *July 1981*

[SEAL]

*Attest:*

GERALD J. MOSSINGHOFF

*Attesting Officer*

*Commissioner of Patents and Trademarks*